United States Patent [19]

Bang

[11] Patent Number: 4,928,560

[45] Date of Patent: May 29, 1990

[54] POWER DRIVEN SCREW DRIVER

[76] Inventor: Kook B. Bang, 115 Bryn Mawr Ave., Newtown Square, Pa. 19073

[21] Appl. No.: 305,404

[22] Filed: Feb. 2, 1989

[51] Int. Cl.[5] ..... B25B 19/00

[52] U.S. Cl. ..... 81/463; 173/119

[58] Field of Search ..... 81/463; 173/119

[56] References Cited

U.S. PATENT DOCUMENTS

| | | | |
|---|---|---|---|
| 1,539,782 | 5/1925 | Stansell . | |
| 1,909,366 | 5/1933 | Koza . | |
| 2,421,901 | 6/1947 | Murad et al. . | |
| 2,625,967 | 1/1953 | Stull . | |
| 2,845,968 | 8/1958 | Luber . | |
| 3,010,193 | 11/1961 | Croall, Jr. et al. . | |
| 3,601,170 | 8/1971 | Sciascia et al. | 145/66 |

*Primary Examiner*—James G. Smith

*Attorney, Agent, or Firm*—Birch, Stewart, Kolasch & Birch

[57] ABSTRACT

An improved screw driver includes a spindle member disposed within a hollow screw driver body, a locking member operatively associated with one end portion of the spindle member, a coiled spring at the other end of the spindle member, a movable shank having a screw holding member and operatively associated with the spindle member, and a clip lever for locking and releasing the locking member, whereby when the clip lever is actuated to release the locking member, a screw to be applied and held by the screw holding member is forced to initially drive the screw into a portion of an object.

10 Claims, 1 Drawing Sheet

POWER DRIVEN SCREW DRIVER

BACKGROUND OF THE INVENTION

1. Field of the Invention

The present invention relates to a power driven screw driver having screw holding means and more particularly, to an improved screw driver including a spindle member disposed within a hollow screw driver body, a locking member operatively associated with one end portion of the spindle member, a coiled spring at the other end of the spindle member, a movable shank having screw holding means and operatively associated with the spindle member, and a clip lever for locking and releasing the locking member, whereby when the clip lever is actuated to release the locking member, a screw to be applied and held by the screw holding means is forced to initially drive the screw in a portion of an object.

2. Description of the Prior Art

There are several types of power driven screw drivers which are known in the art having a coiled spring therein. However, such power driven screw drivers have proven to be unpractical with little if any practical use for the claimed purposes in the construction field. Such power drive screw drivers are shown in U.S. Pat. No. 1,539,782 to Stansell, U.S. Pat. No. 1,909,366 to Koza, U.S. Pat. No. 2,421,901 to Murad et al, U.S. Pat. No. 2,625,967 to Stull, U.S. Pat. No. 2,845,968 to Luber, U.S. Pat. No. 3,010,193 to Croall, Jr., et al, and U.S. Pat. No. 3,601,170 to Sciascia.

SUMMARY OF THE INVENTION

Accordingly, it is an object of the present invention to provide an improved power driven screw driver.

Another object of the present invention is to provide a power driven screw driver including a hollow body, a main spindle member disposed within the hollow body, a locking member operatively associated with one end portion of the main spindle member, a coiled spring connected to the other end of the spindle member, a movable shank operatively associated with the main spindle member, and a clip lever for releasing the locking member whereby, when the clip lever is actuated to release the locking member, a screw held by a movable shank is forced to initially drive the screw into a portion of an object. The clip lever can be used as a clip for clipping the screw driver to a belt or the like. Also the clip lever includes a bent end for preventing the clip lever from moving over when the locking member is moved up.

A further object of the present invention is to provide a power driven screw driver including a movable shank which extends screw holding means such as a screw driver standard head or a screw driver Phillips head which is made of permanent magnet steel for holding various types of screws to be applied.

Still another object of the present invention is to provide a power driven screw driver further including an auxiliary spindle member in parallel to a main spindle member which is operatively associated with an engagement slidably engaged in a slot in one end portion for plentifully engaging with a movable shank and which is operatively associated with an auxiliary locking member disposed in the other end portion thereof for locking and releasing the auxiliary spindle member whereby, when the movable shank is pushed, the main spindle member is locked, and thereafter, when the main spindle member is released, the main spindle member is easily moved forwardly to hit the movable shank and the movable shank is powerfully pushed forward for forcing the screw so as to initially drive the screw into a portion of an object.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a power driven screw driver having holding means which comprises a hollow screw driver body, a main spindle member having a locking member disposed in one end portion and a coiled spring connected to the other end thereof, an auxiliary spindle member in parallel to the main spindle member operatively associated with an auxiliary engagement slidably engaged in a slot disposed in one end portion and an auxiliary locking member disposed in the other end portion thereof wherein the auxiliary spindle member is connected to an auxiliary coiled spring at the other end portion thereof, a movable shank having a groove disposed in the rear end portion for plentifully engaging the auxiliary engagement and operatively associated with one end of the spindle member and a permanent magnet screw driver head disposed in the front end portion thereof for holding various type screws to be applied, and a clip lever for releasing the locking member whereby, after pushing the movable shank while pushing the ball button and locking the locking member, when the locking member is released by pressing the clip lever, the main spindle member hits the movable shank for initially driving one of the screws held by the screw holding means into a portion of an object.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
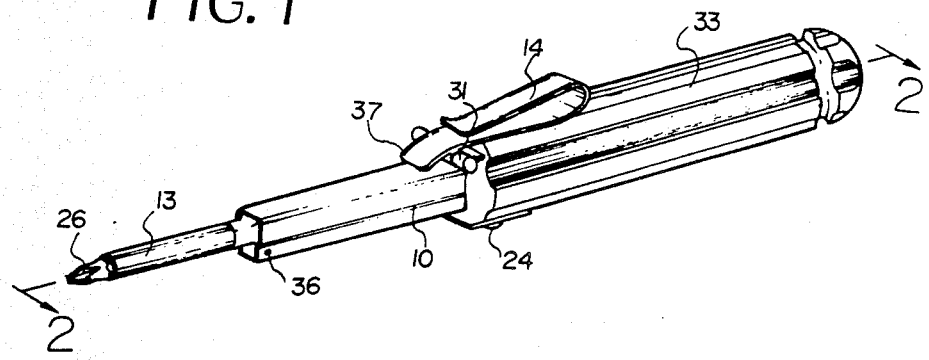
FIG. 1 is a perspective view of a power driven screw driver according to the present invention.

Referring now in detail to the drawings for the purpose of illustrating preferred embodiments of the present invention, the power driven screw driver having screw holding means as shown in FIG. 1 comprises a hollow screw driver body 10, a main spindle member 11 and an auxiliary spindle member 12 both dispose din parallel within the hollow screw driver body 10, a movable shank 13 operatively associated with the main spindle member 11, and a clip lever pivotally attached to the outer surface of the hollow screw driver body 10.

The main spindle member 11 includes a main spindle slot 15 disposed in the front portion thereof for receiving a main locking member 16 having a main locking spring 17, and a main coiled spring 18 connected to the rear end thereof for biasing the main spindle 11 against the internal back portion of the hollow screw driver body 10.

The auxiliary spindle member 12 includes a front slot 34 disposed in the front portion thereof for slidably receiving an engagement 19, a rear slot 20 disposed in the rear portion thereof for receiving an auxiliary locking member 21 having an auxiliary locking spring 22, and an auxiliary coiled spring 23 connected to the rear end thereof for biasing the auxiliary spindle member 12 against the internal back portion of the hollow screw driver body 10. A ball button 24 is movably disposed within a ball button housing 25 formed in the outer surface of the hollow screw driver body 10 in the vicinity of the auxiliary spindle member 12 so that, when the ball button 24 is pushed, the auxiliary locking member 21 is released. The auxiliary spindle member 12 is retained by a cap 35 through a pin 36 secured to the front portion of the hollow screw driver body 10.

Figure 3:
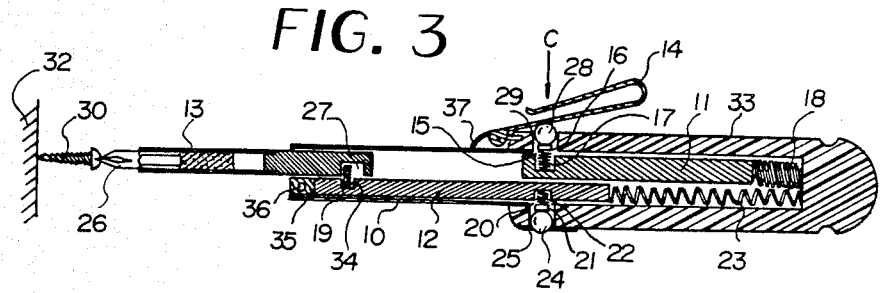
FIG. 3 is a sectional view of FIG. 1, showing in locking position of the power driven screw driver holding a screw according to the present invention.

The movable shank 13 includes a screw driver head 26 extended from the front portion thereof which is made of permanent magnet steel and a large space groove 27 for plentifully engaging the engagement 19 of the auxiliary spindle member 12. The length of the groove is about 0.5–1.0 cm. Also the rear end of the movable shank 13 is operatively hit by the front end of the main spindle member 11 when the main spindle member 11 is returned from the biasing position. The screw driver head 26 is a standard head or a Phillips head for holding various types of screws 30 (FIG. 3).

The clip lever 14 is provided with a movable main ball 28 movably disposed within a main ball housing 29 formed in the outer surface of the hollow screw driver body 10 in the vicinity of the main spindle member 12. When the main locking member 16 touches the movable main ball 28, the main ball 28 is slidably moved up so that the main spindle member 11 is locked and the clip lever 14 is slidably moved up (FIG. 3). Because the clip lever 14 can be pivotaly moved from the outer surface of the screw driver body 10 abut a pivot pin 31. The clip lever 14 has a clip configuration so that the screw driver can be easily clipped to a belt or the like for portability. Also, the clip lever contains a bent end 37 for preventing the clip lever 14 from moving over about the pivot pin 31 when the main locking member 16 is moved up.

Figure 2:
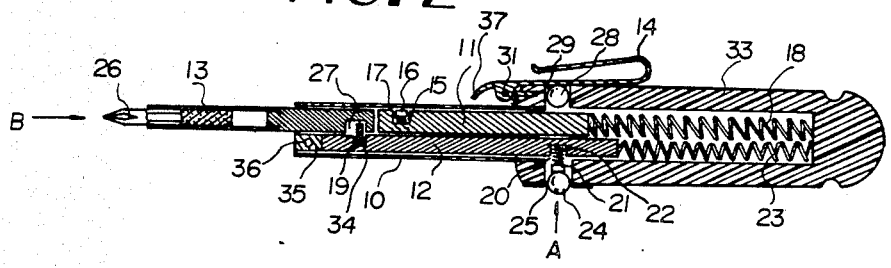
FIG. 2 is a sectional view of FIG. 1, showing the released position of the power driven screw driver according to the present invention.

In operation, when the ball button 24 is depressed in the direction indicated by the arrow (A) as shown in FIG. 2, the auxiliary spindle member 12 is released from its locked position and is free to move within the hollow screw driver body 10. Thus when the movable shank 13 is pressed against the surface of the object e.g. a floor, wall, or the like, that is, in a direction opposite to that indicated by the arrow (B) as shown in FIG. 2, the movable shank 13 and main spindle member 11 move into the hollow screw driver body 10 carrying with them the auxiliary spindle member 12 to which they are attached by the engagement of the engagement member 19 in the large space groove 27. This movement compressed both the main coiled spring 18 and auxiliary coiled spring 23, respectively. In this position the main spindle member 11 is locked by the release of the main locking member 16 into the main ball housing 29 for engagement with the movable main ball 28. As the main locking member 16 engages the movable main ball 28, the lever 14 is raised as shown in FIG. 3. Next, the movable shank 13 is removed from the surface of the object and the ball button 24 is depressed. Accordingly, by the force of the compressed auxiliary coiled spring 23, the auxiliary spindle member 12 is pushed forward carrying with it the movable shank 13 until the auxiliary locking member 21 engages and locks with the ball button housing 25, which is the position shown in FIG. 3. In this locked position, the magnetic screw drive head 26 with the screw 30 is positioned against the desired object 32 to which the screw 30 is to be applied. By depressing the lever 14, the main spindle member 11 is released, striking the base of the movable shank 13 thereby moving the movable shank 13 a distance defined by the large space groove 27. The screw 30 is thus driven a comparable distance into the object 32.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A power driven screw driver having screw means which comprises:

a hollow screw driver body;

a main spindle member disposed within said hollow screw driver body, said main spindle member including a first slot disposed in the front portion thereof for receiving a first locking member, and a first spring connected to the rear end thereof for biasing the main spindle member, an auxiliary spindle member, in parallel to said main spindle member, disposed within said hollow screw driver body, said auxiliary spindle member operatively associated with an auxiliary engagement which is slidably engaged in a second slot disposed in the front end portion, a third slot disposed in the rear end portion for receiving a second locking member operatively connected to a movable ball button, and a second spring connected to the rear end thereof, a movable shank operatively associated with said main spindle member, said movable shank including a groove disposed in the rear end portion thereof for slidably engaging the auxiliary engagement and extending a screw driver head having screw holding means, and a lever pivotably attached to said hollow screw driver body for releasing the first locking member, whereby after pushing the movable shank while pressing the ball button and locking the main spindle member, when the first locking member is released, the main spindle member hits the movable shank for initially driving a screw held by the screw holding means into a portion of an object.

2. The power driven screw driver of claim 1, wherein the first locking member includes a short coiled spring extended from said first locking member, wherein one end of the short coiled spring is attached to the bottom of the first slot for readily locking and releasing the first locking member by pressing or not pressing the first locking member.

3. The power driven screw driver of claim 1, wherein the first spring is a powerful long coiled spring.

4. The power driven screw driver of claim 1, wherein the second locking member includes a short coiled spring extended from said second locking member, wherein one end of the short coiled spring is attached to the bottom of the second slot for readily locking and releasing the second locking member by pressing or not pressing the second locking member.

5. The power driven screw driver of claim 1, wherein the second spring is a long coiled spring.

6. The power driven screw driver of claim 1, wherein the length of the groove disposed in the shank is about 0.5–1.0 cm.

7. The power driven screw driver of claim 1, wherein the lever is provided with a movable ball disposed within a ball housing which is formed in the outer surface of the hollow screw driver body in same side of the lever.

8. The power driven screw driver of claim 1, wherein the movable ball button is disposed within a ball button housing formed in the outer surface of the hollow screw drive body on the opposite side of the lever.

9. The power driven screw driver of claim 1, wherein the lever has a clip-shaped configuration for easily clipping the power driven screw driver to a belt.

10. The power driven screw driver of claim 1, wherein the lever contains a bent end for preventing the lever from moving over when the first locking member is moved up.

* * * * *